US010699609B2

(12) United States Patent
Barton et al.

(10) Patent No.: US 10,699,609 B2
(45) Date of Patent: Jun. 30, 2020

(54) ANIMATED LIQUID DROPLET ENVIRONMENTS

(71) Applicant: Disney Enterprises, Inc., Burbank, CA (US)

(72) Inventors: Mark Robert Barton, La Canada Flintridge, CA (US); Michael P. Goslin, Sherman Oaks, CA (US); Eric C. Haseltine, Silver Spring, MD (US)

(73) Assignee: Disney Enterprises, Inc., Burbank, CA (US)

( * ) Notice: Subject to any disclaimer, the term of this patent is extended or adjusted under 35 U.S.C. 154(b) by 646 days.

(21) Appl. No.: 15/000,278

(22) Filed: Jan. 19, 2016

(65) Prior Publication Data

US 2017/0206814 A1 Jul. 20, 2017

(51) Int. Cl.

| | |
|---|---|
| ***G09F 19/00*** | (2006.01) |
| ***G09F 19/12*** | (2006.01) |
| ***G09F 19/20*** | (2006.01) |
| ***G09F 19/02*** | (2006.01) |
| ***G09F 13/00*** | (2006.01) |
| ***B05B 17/08*** | (2006.01) |

(52) U.S. Cl.

CPC ..... *G09F 19/12* (2013.01); *B05B 17/08* (2013.01); *G09F 13/005* (2013.01); *G09F 19/02* (2013.01); *G09F 19/20* (2013.01)

(58) Field of Classification Search

CPC ..... B05B 17/085; G03B 21/204; G03B 21/2013; G03B 21/208; G03B 21/2066

USPC ..... 239/18; 362/96, 101; 222/422; 40/406, 40/407, 408, 439, 442; 353/31, 94

See application file for complete search history.

(56) References Cited

U.S. PATENT DOCUMENTS

| | | | | |
|---|---|---|---|---|
| 3,387,782 | A | 6/1968 | Shuzo | |
| 4,294,406 | A | 10/1981 | Pevnick | |
| 4,426,021 | A | 1/1984 | Rosenthal | |
| 5,165,580 | A | 11/1992 | Rosenthal | |
| 5,213,338 | A * | 5/1993 | Brotz | A61B 5/0478 273/453 |
| 5,736,969 | A * | 4/1998 | Kuga | G02B 27/2271 239/18 |
| 9,223,192 | B1 * | 12/2015 | Linnell | G03B 21/10 |

(Continued)

OTHER PUBLICATIONS

Grand Illusions, Levitating Waters, YouTube, uploaded Jul. 18, 2014, <https://www.youtube.com/watch?v=i8sad03JAP0>.

(Continued)

*Primary Examiner* — Viet Le

(74) *Attorney, Agent, or Firm* — Patterson + Sheridan, LLP

(57) ABSTRACT

Embodiments herein describe a dripping system that displays an animation using different colored light sources. In one embodiment, the dripping system includes red, green, and blue light sources which can be activated individually or in combination to emit light that reflects off liquid droplets emitted by the dripping system. Controlling the timing of the light sources permits the dripping system to illuminate the water droplets at different locations along their path which generate the animations. In one embodiment, the dripping system changes animations or alters the animation in response to user interaction. For example, different user hand gestures may be mapped to different water droplet animations. An input/output (I/O) system detects the user interaction and changes the displayed animation.

15 Claims, 5 Drawing Sheets

(56) References Cited

U.S. PATENT DOCUMENTS

| | | | | |
|---|---|---|---|---|
| 2013/0300728 | A1* | 11/2013 | Reichow | G09G 3/36 345/419 |
| 2014/0226309 | A1 | 8/2014 | Rosenthal | |
| 2014/0240958 | A1 | 8/2014 | Fuller et al. | |

OTHER PUBLICATIONS

Levitating Waters, Levitating Waters—Gravity Defying Water, Amazon.com, Inc., 5 pages, <http://www.amazon.com/Levitating-Waters-Gravity-Defying-Water/dp/B00OBSMOLA/ref=sr_1_1?ie=UTF8&qid=1449258768&sr=8-1&keywords=levitating+water>.

* cited by examiner

ANIMATED LIQUID DROPLET ENVIRONMENTS

BACKGROUND

Field of the Invention

Embodiments presented in this disclosure generally relate to displaying colored animations using liquid droplets.

Description of the Related Art

Lighting can be used to add effects to physical environments. For example, illuminating different portions of a physical environment can create different effects. Lighting effects can be used for various purposes such as highlighting certain objects, creating illusions, and the like. In some environments, the lighting effects and the medium being illuminated can both be manipulated to create different effects.

SUMMARY

One embodiment presented herein is a method that includes dispensing a plurality of liquid droplets that free fall along a vertical path and illuminating the plurality of liquid droplets to generate a multi-colored animation with the plurality of liquid droplets as the droplets fall along the vertical path. The method also includes detecting a predefined user interaction and altering the multi-colored animation in response to the detected user interaction.

Another embodiment presented herein is a computer-readable storage medium having computer-readable program code embodied therewith. The computer-readable program code is configured to dispense a plurality of liquid droplets that free fall along a vertical path and illuminate the plurality of liquid droplets to generate a multi-colored animation with the plurality of liquid droplets as the droplets fall along the vertical path. The computer code is configured to detect a predefined user interaction and alter the multi-colored animation in response to the detected user interaction.

Another embodiment presented herein is a dripping system that includes a first light source configured to emit a first color and a second light source configured to emit a second color different from the first color. The dripping system includes a strobe controller configured to activate first and second light sources to generate a multi-colored animation as liquid droplets fall along a vertical path and a drip head configured to dispense the droplets at a defined rate along the vertical path.

BRIEF DESCRIPTION OF THE DRAWINGS

So that the manner in which the above recited aspects are attained and can be understood in detail, a more particular description of embodiments of the invention, briefly summarized above, may be had by reference to the appended drawings.

It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

The embodiments herein describe a dripping system that displays an animation using different color light sources. In one embodiment, the dripping system includes red, green, and blue light sources which are activated individually or in combination to emit light that reflects off liquid droplets emitted by the dripping system. Controlling the timing of the light sources permits the dripping system to illuminate the water droplets at different locations along their path which results in different colored animations—e.g., a waving flag, a lit candle, a string of pearls, etc.

In one embodiment, the dripping system changes animations or alters the current animation in response to predefined user interaction. User interactions may be mapped to particular changes in the animation displayed by the dripping system. For example, different predefined user hand gestures may be mapped to respective water droplet animations. An input/output (I/O) system (e.g., a video capture system or a motion sensing toy) detects the user interaction and changes the displayed animation.

In one embodiment, the I/O system includes a brain activity monitor which alters the animation outputted by the dripping system in response to the electrical activity of the brain of the user. For example, as the user relaxes, the brain activity monitor may cause the frequency of the strobe lights to change until the frequency matches the rate at which the water droplets are emitted. As such, the droplets appear to be frozen in place which can give the impression to the user that she has stopped time or frozen the water using only her mind.

Figure 1:
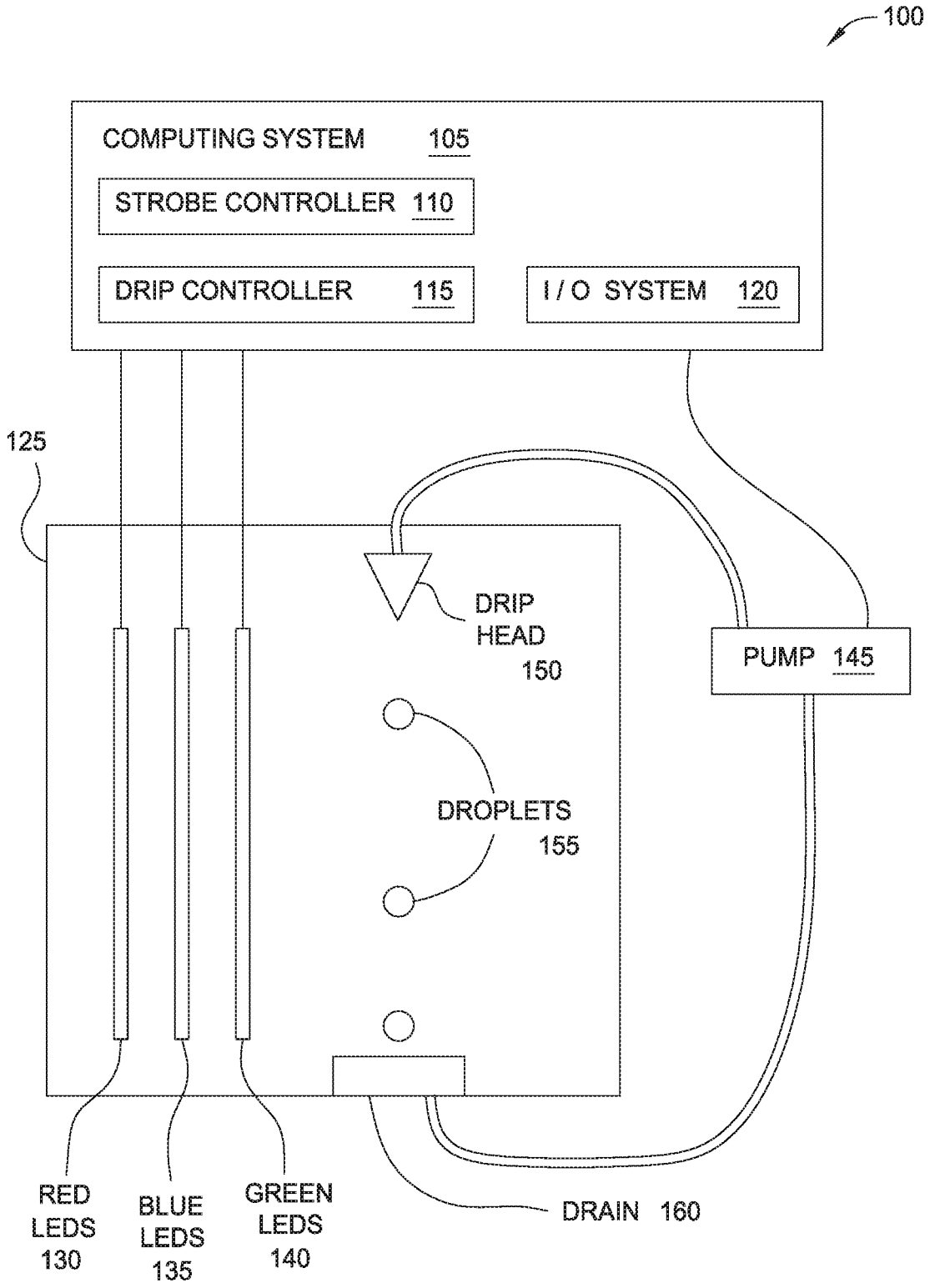
FIG. 1 is a dripping system for displaying colored animations using liquid droplets, according to one embodiment described herein.

FIG. 1 is a dripping system 100 for displaying colored animations using liquid droplets, according to one embodiment described herein. The dripping system 100 includes a computing system 105, a dripping apparatus 125, and a pump 145. The computing system 105 includes a strobe controller 110 coupled to colored lights source in the dripping apparatus 125 (i.e., red LEDs 130, blue LEDs 135, and green LEDs 140). As described in more detail below, the strobe controller 110 turns on and off the light sources to generate an animation by reflecting light off the droplets 155. The strobe controller 110 may be communicatively coupled to the drip controller 115 so that the strobe controller 110 knows the current rate at which the liquid droplets 155 are being emitted by the drip head 150 (e.g., 60 Hz/60 droplets per second). Using this information, the strobe controller 110 can determine the location of the droplets 155 in a vertical path between the drip head 150 and a drain 160. The strobe controller 110 then turns on the light sources in synch with the location of the droplets 155 to generate the desired animation. These animations can include either one color or multiple colors. Furthermore, an animation as used herein can include a display where the droplets 155 do not appear to move. For example, if the rate at which the strobe controller 110 activates one of the light sources is the same rate at which the drip controller 115 dispenses the droplets 155, then in this animation the droplets 155 appear motionless to the user. Stated differently, if the strobe controller 110 repeatedly activates the light sources when the droplets 155 are in the same locations in the vertical path, the droplets 155 appear motionless to the user.

The drip controller 115 is communicatively coupled to the pump 145 in order to set or change the rate at which the drip head 150 outputs the droplets 155. In one embodiment, the pump 145 is a water pump, but the embodiments herein are not limited to water and can be used with any type of liquid that has the necessary viscosity and reflective properties to display an animation when illuminated by the light sources. In one embodiment, an additive is added to the liquid which increases or decreases the reflectivity of the liquid. For example, a colored dye may be added to water to cause the droplets 155 to reflect more of the light emitted by the LEDs 130, 135, and 140. Additionally or alternatively, a fluorescent material may be added to the water in order to make the droplets 155 fluoresce when struck by light.

As shown, the dripping apparatus 125 relies on gravity to propel the droplets 155 from drip head 150 to the drain 160. In this example, the droplets 155 captured by the drain 160 are fed back into the pump 145 to be reused, however, this is nota requirement. In another example, the dripping apparatus 125 may include an adapter that is attached to a faucet, shower head, or hose which includes the drip head 150. In this scenario, the pump 145 would not be needed since the water pressure from a utility provider can be used to output the droplets 155. Moreover, the adapter may include a selection feature (e.g., a switch or dial) for changing the rate at which the droplets 155 are emitted.

Although dripping system 100 uses red, green, and blue LEDs 130, 135, and 140 as the light sources for illuminating the droplets 155 and generating the animations, other colored light sources may be used. For example, the dripping apparatus 125 may include two or four different light sources, or use red, yellow, and blue light sources rather than red, green, and blue as shown here. In one embodiment, the LEDs are arranged on LED strip lights or ribbon lights (e.g., a red LED strip, a blue LED strip, and a green LED strip) that are arranged parallel to the vertical path followed by the droplets 155. In one embodiment, the LEDs are equally spaced along the path followed by the droplets 155 such that the light illuminates the water droplets 155 the same regardless of the particular location of the droplet 155 along the vertical path. For example, equally spacing the lights may prevent water droplets that are in the middle of the path from being illuminated brighter than droplets near the head 150 or the drain 160. Moreover, although LEDs are used as the light sources in FIG. 1, the dripping apparatus 125 may use any suitable light source that can strobe (e.g., turn on and off in less than 10 milliseconds).

In one embodiment, the LEDs may be occluded from the view of the user such that the LEDs are not directly visible to the user. For example, the LEDs may be mounted on a wall that is between the LEDs and the viewer. However, the dripping apparatus 125 may include a cut out in the wall which permits the viewer to see the droplets 155 but not the LEDs. For example, the drip head 150 and drain 160 may be recessed in the apparatus 125 such that the light emitted by the LEDs strikes the droplets 155 and is then reflected out of the cut out towards the viewer. Moreover, other surfaces in the dripping apparatus 125 may be covered with a non-reflective material (e.g., black cloth) that absorbs the light emitted by the LEDs rather than reflecting the light towards the viewer. Doing so may improve the contrast between the droplets 155 and the other surfaces in the apparatus 125, and thus, improve the visibility of the droplets 155.

The computing system 105 also includes an I/O system 120 which permits a user to interact with the dripping apparatus 125. The I/O system 120 may include a video capturing device, motion sensor, depth sensor, a button, dial, switch, and the like. For example, the I/O system 120 may track the motions of the user and match these motions to a predefined action. For instance, the user may make several hand gestures, each of which are recognizable to the I/O system 120. As described in more detail below, the I/O system 120 may use user interactions to generate commands for the strobe controller 110 which affect the animation displayed using the droplets 155.

Figure 2:
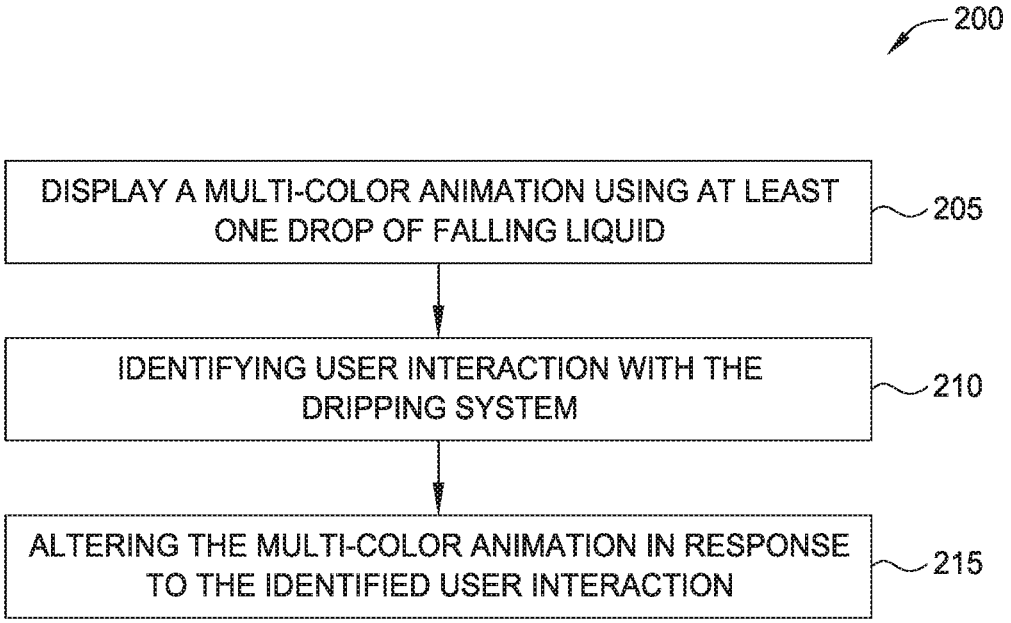
FIG. 2 is a flow chart for altering animations displayed using liquid droplets in response to user interaction, according to one embodiment described herein.

FIG. 2 is a flow chart of a method 200 for altering animations displayed using liquid droplets in response to user interaction, according to one embodiment described herein. At block 205, the dripping apparatus displays a multi-colored animation using at least one drop of a falling liquid. Although many of the embodiments described below display animations with multiple colors, the animations may include a single color. By strobing the light sources (e.g., the LEDs), the dripping apparatus can illuminate each of the water droplets currently falling from the drip head. For example, if the strobe controller turns the red LEDs on and off quickly (e.g., less than 10 milliseconds), the viewer sees a red dot at each of the locations of the water droplets along the path. If there are five droplets currently falling from the drip head to the drain, the viewer sees five red dots that correspond to the dimensions and locations of the five water droplets. Alternatively, the strobe controller may strobe multiple light sources simultaneously to yield different colors. For example, the strobe controller may turn on and off both the red and blue lights thereby generating purple dots at each location of the water droplets.

In one embodiment, the strobe controller may activate the light sources for longer periods of time rather than strobing the light sources. Doing so changes a portion of the animation from a dot to an ellipse or a rectangle with rounded ends. To do so, the strobe controller keeps the light source on while the water drop falls, thereby reflecting light at different locations along its path. Because the drop may fall faster than the human eye can capture images, the viewer sees the light reflecting off of the droplet at different locations as one single feature or shape. Stated differently, the human eye does not have the ability to process images fast enough to see the precise location of the droplets as they fall. Instead, the viewer perceives the water droplets more as a stream or a general area that includes the water droplet or droplets. Because the human eye cannot precisely identify the location of the water droplets at any given time, the strobe control can control the length of time the light sources are turned on in order to display different shapes using the water droplets.

Figure 3:
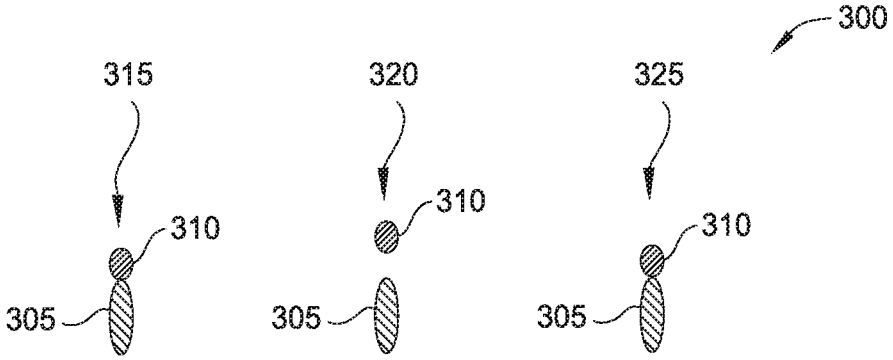
FIGS. 3-5 illustrate different animations formed using liquid droplets, according to one embodiment described herein.
Figure 4:
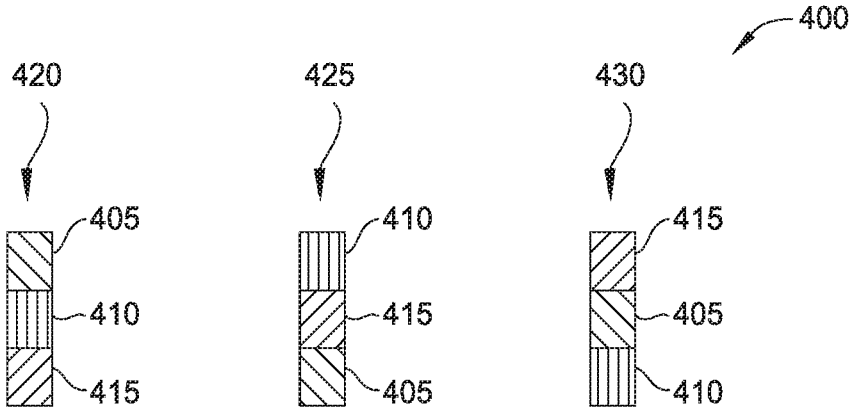
Figure 5:
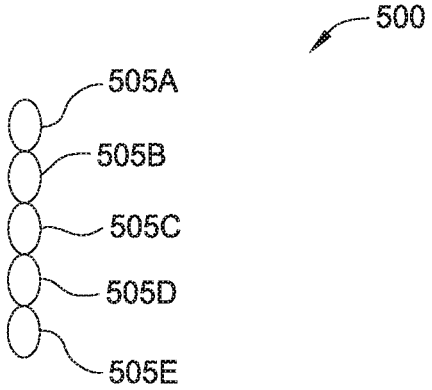

Moreover, the strobe controller can illuminate different colors at different times but still give the viewer the impression that the colors were emitted at the same time. For example, because the human eye may see strobes that occur within, e.g., 100 microseconds of each other as occurring at the same time, the strobe controller can strobe the red LEDs at time A, turn off the red LEDs, and then strobe the blue LEDs at time B to illuminate a water droplet at a first location as a red dot and then illuminate the same water droplet at a second, different location as a blue dot. If time A and B are within 1 millisecond, the user views the red and blue dots simultaneously at two different locations even though the same water droplet was used and the red and blue LEDs were activated at non-overlapping times. FIGS. 3-5 illustrate different animations that can be generated using the dripping system 100 illustrated in FIG. 1.

FIG. 3 illustrates a colored animation 300 formed using droplets, according to one embodiment described herein. Specifically, FIG. 3 illustrates three images of animation 300 which includes a first colored portion 305 and a second colored portion 310. In one embodiment, the animation 300 is intended to simulate a lit candle with a flickering flame.

In a first image 315, a first water droplet is illuminated once it reaches the location of portion 310. Because portion 310 (i.e., the flame) is smaller than portion 305 (i.e., the candle), the strobe controller may activate a light source for a shorter amount of time. As such, the viewer sees an illuminated portion 310 that is similar to the dimensions of the water droplet. Once the water droplet reaches the top part of portion 305, the strobe controller activates a different light source for a longer amount of time such that the droplet is illuminated while the droplet travels from the top of portion 305 to the bottom of portion 305. In this manner, image 315 includes the portion 305 which has a different color and different shape than the portion 305. Moreover, although image 315 may be outputted using only a single water droplet, in other embodiments, the strobe controller may use multiple drops to generate the image 315.

As described above, the user may perceive the entire image 315 as a whole rather than seeing portions 310 and 305 individually. That is, the strobe controller can generate the image 315 so that the viewer believes the lights illuminating the droplet are on at the same time when in fact the opposite is true. So long as the light sources are active within a time frame that is less than or equal to the sampling time of the human eye, the portions 305 and 310 are perceived as being illuminated in parallel. However, the first light source (e.g., a yellow light source) may be on for only portion of the time frame while the second light source (e.g., a blue light source) is on for the remaining portion of the time frame.

Later, the strobe controller generates image 320 which includes a separation distance between the first portion 310 and the second portion 305 to simulate the flickering effect of a lit candle. Like image 320, the strobe controller may activate the light sources within a time frame so that the viewer believes the light sources were activated simultaneously. As a result, the viewer sees the illuminated portions 305 and 310 at the same time.

In one embodiment, images 315 and 320 are displayed such that the viewer does not view these images at the same time. That is, the strobe controller may purposefully extend the time frames used to display the images 315 and 320 so that the viewer sees the images 315 and 320 as two separate images rather than the same image, thereby preventing the images 3015 and 320 from blending together. For example, the first and second images 315, 320 may be displayed using non-overlapping time frames which give the viewer enough time to process and identify the images 315, 320 separately.

Image 325 occurs after image 320. Here, the strobe controller activates the light sources to illuminate a droplet such that portion 310 is again contacting portion 305 (like in image 315). As such, to the perspective of the person viewing images 315, 320, and 325, the first portion 310 (i.e., the flame) appears to flicker up and down relative to the second portion 305 (i.e., the candle) over time. Although FIG. 3 illustrates only three images to generate this flickering effect, the strobe controller may output multiple intermediate images between image 315 and image 320 where the distance between the upper portion 310 and the lower portion 305 steadily increases until reaching the separation distance shown in image 320. Similarly, the animation 300 may include multiple intermediate images between images 320 and image 325 where the distance between the upper portion 310 and the lower portion steadily decreases until the two portions 305, 310 contact as shown by image 325.

In one embodiment, the images 315, 320, and 325 (or portions thereof) are disposed in the same location along the vertical path traveled by the droplets. For example, the strobe controller may activate the light sources so that the portion 305 (e.g., the candle) is at the same location in the path for each image. As a result, to the user, the location of the portion 305 does not change. Each time a droplet passes through the location defined by portion 305, the strobe controller activates the light to "refresh" portion 305. So long the rate at which the droplets are emitted is equal to or faster than the rate at which the human eye processes images, to the viewer it appears as if the portion 305 is constantly illuminated.

FIG. 4 illustrates an animation 400 that includes image 420, 425, and 430. Each of the images includes three different colored sections—i.e., portions 405, 410, and 415. In each image, the animation 400 rotates the portions 405, 410, and 415 so that the colored sections are disposed at different spatial locations along the vertical path traveled by the droplets. As above, the animation 400 may include multiple intermediary images between the images shown. For example, during the intermediary images, the upper portion (i.e., portion 405) may wrap around such that a sub-section of portion 405 is displayed at both the top and the bottom. Stated differently, between images 420 and 425, the size of the portion 405 at the top of the animation 400 may begin to decrease while the size of the portion 405 at the bottom of the animation 400 increases. Eventually, the animation 400 looks like image 420 where all of the colored portion 405 is at the bottom while portion 410 is now at the top. The process may continue between images 425 and 430 where the colored portion 410 shifts from the top to the bottom of the animation 400 such that portion 415 is now at the top as shown in image 430.

In one embodiment, the images 420, 425, and 430 are disposed on the same location within the vertical path traveled by the droplets. That is, to the user, each image 420, 425, and 430 is displayed in the same location along the vertical path while the colored portions 405, 410, and 415 within each of the images change positions. However, this is not a requirement. In another embodiment, the locations of the images 420, 425, and 430 may change along the vertical path.

FIG. 5 illustrates an animation 500 that displays a single image using multiple strobes of a light source. To generate animation 500, the strobe controller may activate a light source when a single droplet reaches the location corresponding to each portion 505—i.e., 505A, 505B, 505C, and so forth. Unlike when generating portion 305 in animation 300, the strobe controller turns the light source on and off rather than leaving the light source on as the droplet falls along the vertical path. If timed correctly, the portions 505 have the same shape as the water droplets where each portion 505 contacts its neighboring portions 505. As such, animation 500 may represent a necklace such as a string of pearls. In one embodiment, each portion 505 may be illuminated using the same light source (or the same combination of lights sources) so the portions 505 are the same color.

Alternatively, different light sources may be used for different portions 505 so that the animation 500 has different colors.

In one embodiment, the viewer perceives each portion 505 of the animation 500 as being displayed simultaneously even though each portion 505 is illuminated using different strobes of light. As long as the rate at which the droplets are emitted is equal to or faster than the rate at which a human captures visual information, the strobe controller can constantly refresh the image using different droplets so that the user perceives the animation 500 as an unchanging image of connected spheres.

In one embodiment, the strobe controller can change when the light source is activated such that the portions 505 begin to move vertically, either up or down. For example, by delaying the strobes, the portions 505 will begin to move down when illuminating subsequent droplets. That is, by slowing reducing when the light source is strobed, the portions 505 illuminated using subsequent droplets occur at later times when the droplets have traveled further away from the head. Thus, it appears to the user that the portions 505 (or the beads) are moving downward. The reverse is true when the strobe rate is increased. In this case, the light source is activated earlier when the droplets are closer to the head, and thus, the portions 505 appear to be shifting up. This same change can be used in animations where the portions 505 are not connected. If the light source is activated when the droplets are always in the same location along the vertical path, it appears to the viewer as if the portions 505 are floating. By slowly increasing the rate between strobes, the portions 505 begin to shift up towards the head, and vice versa.

Returning to method 200, at block 210, the I/O system identifies user interaction with the dripping system. As described above, the I/O system may include a video capture system or a motion sensing toy which maps user interactions to specific actions taken by the dripping system. For example, in a gaming environment, different user gestures may correspond to different magical spells. By capturing user motion, the I/O system can determine if the current user motion matches a predefined (or known) gesture that corresponds to a spell. The I/O system may process video data or user sensor output from accelerometers or gyroscopes to capture user motion. In another example, the I/O system may include controller such as a video game controller, mouse, keyboard, touch screen, or other device that permits the user to provide commands to the I/O system.

Once a user interaction is matched to an action taken by the dripping system, the I/O system sends a notification to the strobe and/or drip controllers. For example, if the user motion matches the gesture of a particular spell, the I/O system sends a data signal indicated the spell was performed. Similarly, if the user presses a button on a controller, the I/O system informs the strobe controller of the action corresponding to the button.

At block 215, the strobe controller alters the multi-colored animation in response to the identified user interaction. In one embodiment, the strobe controller may slow down or speed up the rate at which the animation changes in response to the user interaction. Using animation 400 illustrated in FIG. 4 as an example, the strobe controller may alter the rate at which the colored portions 405, 410, and 415 change positions. For example, instead of the animation 400 repeating every two seconds, it may repeat every three seconds.

In another embodiment, the strobe controller may change the animation to a different type. That is, by activating a button, the user instructs the strobe controller to change from the candle animation 300 shown in FIG. 3 to the string of pearls animation 500 shown in FIG. 5.

In another embodiment, the strobe controller may change the color of the animation in response to the user interaction. For example, instead of illuminating portions 505 of animation 500 with white light, the strobe controller may instead use different colors to illuminate each portion 505. Alternatively or additionally, the strobe controller may change the brightness of the light sources. For example, the user may desire to increase the luminance of the animation. In response, the strobe controller may increase the brightness of the light sources when being activated which increase the amount of light reflected by the droplets.

In one embodiment, the drip controller alters the rate at which the droplets are generated in response to the user interaction. For example, different animations may require different drip rates. As the user switches between animation types, the drip controller may adjust the drip rates accordingly.

Figure 6:
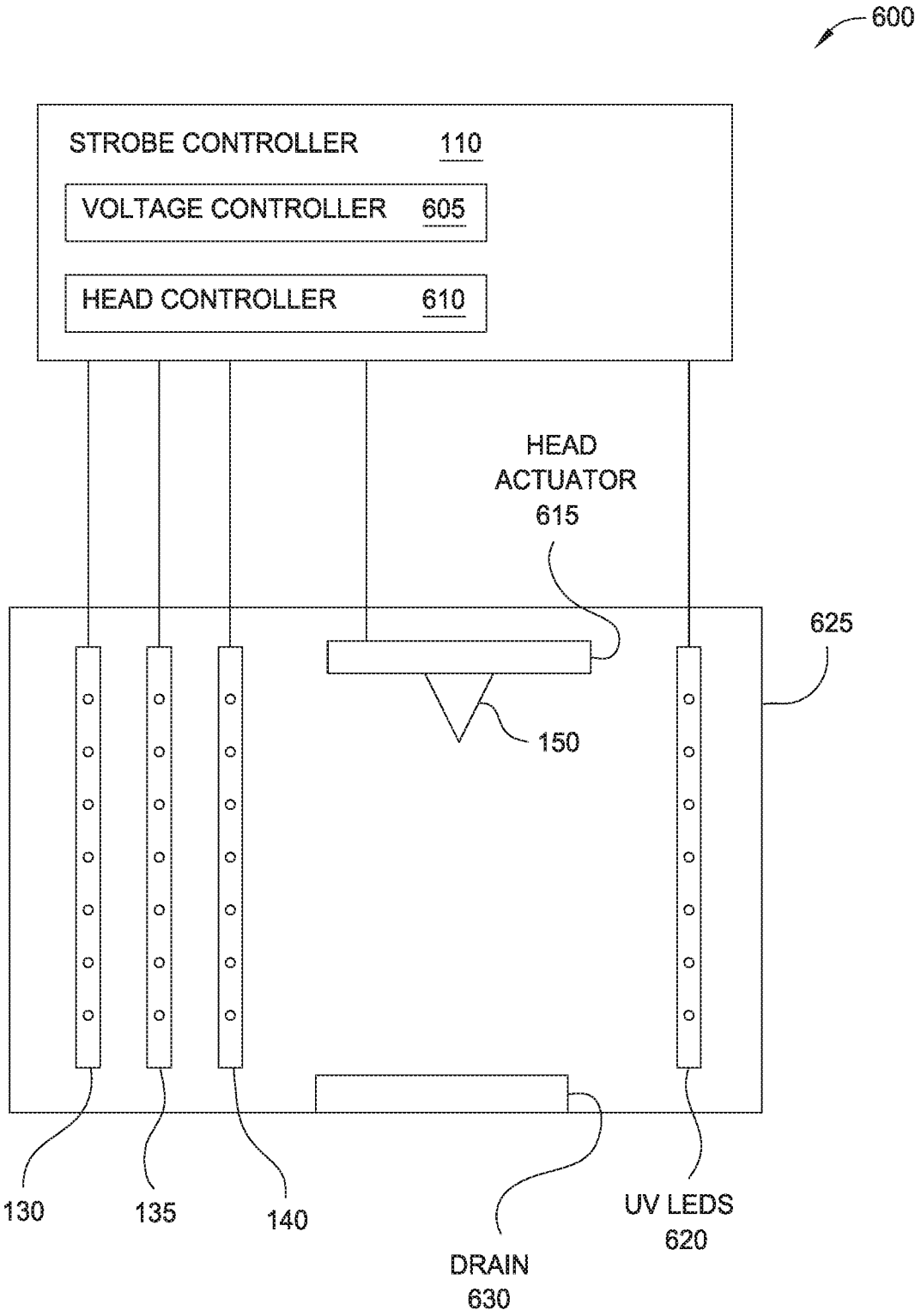
FIG. 6 is a dripping system for displaying animations using liquid droplets, according to one embodiment described herein.

FIG. 6 is a dripping system 600 for displaying colored animations using liquid droplets, according to one embodiment described herein. The dripping system 600 includes the strobe controller 110, and a dripping apparatus 625. The strobe controller 110 may be similar to the strobe controller described in FIG. 1. In addition, the strobe controller 110 includes a voltage controller 605 and head controller 610. The voltage controller 605 may control the brightness of the LEDs 130, 135, and 140 when activated. As described above, the user may use the I/O system (not shown) to change the brightness of the light sources, thereby changing the brightness of the animation.

The head controller 610 sends instructions to a head actuator 615 which moves the drip head 150. That is, instead of the drip head 150 remaining in a stationary position, the actuator 615 can move the drip head 150 to different locations within the apparatus 625. In one embodiment, the head actuator 615 moves the drip head along an axis (e.g., the horizontal direction) to generate different animations in tandem with the LEDs 130, 135, and 140. As a result, the dripping apparatus 600 includes a larger drain 630 for capturing droplets that are emitted by the drip head 150 along this axis. In another embodiment, the head actuator 615 moves the drip head 150 along multiple axes so that the head 150 can be moved in a square pattern, circular pattern, elliptical pattern, etc. In one embodiment, the head controller 610 is synchronized with the strobe controller 110 such that the movement of the drip head 150 and the activation of the LEDs 130, 135, and 140 create animations. For example, the dripping apparatus 600 may generate an animation that corresponds to a tornado, or a sheet of falling rain.

In one embodiment, the dripping apparatus 625 may include multiple drip heads 150. For example, two drips heads may be mounted on the head actuator 615 which can be moved to generate an animation. For instance, some animations may require the drip head 150 to move quickly which may increase the cost and complexity of the actuator 615. Instead, the dripping apparatus 625 may include multiple drip heads 150 which can be moved simultaneously using the same head actuator 615 or separate actuators which reduces the speed at which the heads 150 must be moved to generate the animation. Alternatively, one of the drip heads 150 may be stationary while another drip head 150 is mounted to the head actuator 615.

Moreover, the dripping apparatus 625 includes ultraviolet (UV) LEDs 620 which can be used to enhance the contrast between the displayed animation and the background surfaces in the dripping apparatus 625. In one example, the area of the dripping apparatus 625 behind the drip head 150 relative to the view of the user may be covered with a non-reflective material (e.g., a black colored material). Activating the UV LEDs 620 may further decrease the amount of light that is reflected off the non-reflective material, and thus, increase the contrast between the light reflected by the droplets and the light reflected by the area of the apparatus 625 behind the droplets.

Figure 7:
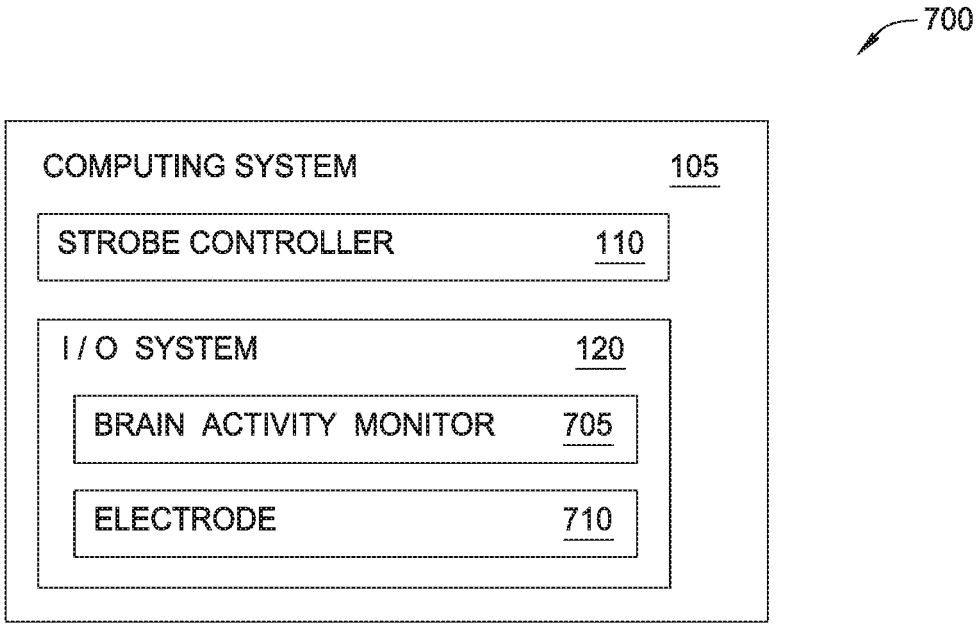
FIG. 7 is a computing system for varying animations displayed using liquid droplets by monitoring brain activity, according to one embodiment described herein.

FIG. 7 is a computing system 105 for varying animations by monitoring brain activity, according to one embodiment described herein. Like the computing system in FIG. 1, computing system 105 includes the strobe controller 110 and I/O system 120. As shown, the I/O system 120 includes a brain activity monitor 705 and an electrode 710. In one embodiment, the brain activity monitor 705 uses electroencephalography (EEG) to record electrical activity of the brain. To do so, the user places the electrode 710 on or near her scalp to permit the monitor 705 to measure voltage fluctuations resulting from ionic current within the neurons of the brain. While one electrode 710 is shown, the I/O system 120 may include multiple electrodes disposed at different locations on the user's head. Moreover, the electrodes may be disposed on an apparatus such as a helmet, headphones, or the arms of a pair of glasses to position the electrodes near the scalp when worn.

In one embodiment, the brain activity monitor 705 measures the spectral content of the EEG signals (commonly referred to as brain waves) which can be correlated to specific user interactions that are used to alter the animation being displayed using the droplets. Stated differently, the brain activity monitor 705 alters the animation outputted by the dripping system in response to the electrical activity of the brain of the user. For example, as the user relaxes, this may change the spectral content of the EEG in a certain way that is detected by the brain activity monitor 705. In response, the brain activity monitor 705 may cause the frequency of the strobe lights to change such that the droplets are always illuminated at the same location along the vertical path. As such, the droplets appear to be frozen in place which can give the impression to the user that she has stopped time or frozen the water using only her mind.

The EEG signals can be correlated to different user interactions. In one embodiment, the user may perform a training process to configure the brain activity monitor 705 to correlate different user interactions (e.g., different emotions) to changes in the EEG signals. For example, the monitor 705 may evaluate the EEG signals as the user changes her emotions—e.g., when the user is nervous, relaxed, excited, happy, angry, etc. The EEG signals measured by the brain activity monitor 705 as the user switches between these emotional states can be measured and saved so they can be detected later in order to alter the animation. Alternatively, the mapping between the EEG signals and the animations may already be predefined, in which case, the user can learn how to alter her emotional state in order to alter the animation. For example, to change from an animation simulating a sunny day by displaying a bright yellow necklace to an animation simulating lighting flashes, the user may learn how to change her emotional state (e.g., from happy to angry) so that her brain activity matches the predefined EEG signals for each animation. Thus, when used in a gaming environment, the brain activity monitor 705 can "magically" alter the animation displayed by the droplets to match a mood of the user or give the perception to the user that she is controlling time.

In the preceding, reference is made to embodiments of the invention. However, it should be understood that the invention is not limited to specific described embodiments. Instead, any combination of the preceding features and elements, whether related to different embodiments or not, is contemplated to implement and practice the invention. Furthermore, although embodiments of the invention may achieve advantages over other possible solutions and/or over the prior art, whether or not a particular advantage is achieved by a given embodiment is not limiting of the invention. Thus, the aspects, features, embodiments and advantages described herein are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order or out of order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While the foregoing is directed to embodiments of the present invention, other and further embodiments of the invention may be devised without departing from the basic scope thereof, and the scope thereof is determined by the claims that follow.

What is claimed is:

1. A method, comprising:

dispensing, via one or more moveable drip heads, a plurality of liquid droplets that free fall along a vertical path in an animated dripping system;

illuminating, by a plurality of light sources in the animated dripping system, the plurality of liquid droplets to generate a multi-colored animation as the pluarality of liquid droplets fall along the vertical path;

detecting, using one or more sensors of the animated dripping system, a predefined user interaction with the animated dripping system;

matching the predefined user interaction to a predefined action taken by the animated dripping system; and altering the multi-colored animation according to the predefined action and in response to the detected predefined user interaction by:

altering a position of the one or more moveable drip heads; and altering the illumination of the plurality of liquid droplets.

2. The method of claim 1, wherein displaying the multi-colored animation comprises:

activating a first light source when a first droplet of the plurality of droplets is at a first location along the vertical path; and activating a second light source when the first droplet is at a second location along the vertical path, wherein the first and second light sources are activated during non-overlapping time periods, and wherein the first and second light source emit different color light.

3. The method of claim 2, wherein the first and second light sources are both activated within a time frame such that, from a perspective of a viewer, the first and second light sources are activated simultaneously to generate an image of the multi-colored animation.

4. The method of claim 2, wherein the first light source is activated for a different duration than the second light source to generate the multi-colored animation.

5. The method of claim 1, wherein the multi-colored animation comprises a first image and a second image, wherein both the first and second images comprise a first colored portion and a second colored portion, wherein at least one of the first and second colored portions is in a different location along the vertical path in the first image than in the second image.

6. The method of claim 1, wherein altering the multi-colored animation comprises at least one of changing a type of the multi-colored animation and changing a rate at which images forming the multi-colored animation are changed.

7. The method of claim 1, wherein identifying user interaction with the animated dripping system comprises:

measuring brain activity of a user using at least one electrode coupled to a head of the user.

8. A computer-readable storage medium having computer-readable program code embodied therewith, the computer-readable program code configured to:

dispense, via one or more moveable drip heads, a plurality of liquid droplets that free fall along a vertical path in an animated dripping system;

illuminate, by a plurality of light sources in the animated dripping system the plurality of liquid droplets to generate a multi-colored animation as the plurality of liquid droplets fall along the vertical path;

detect, using one or more sensors of the animated dripping system, a predefined user interaction with the animated dripping system;

match the predefined user interaction to a predefined action taken by the animated dripping system and alter the multi-colored animation according to the predefined action and in response to the predefined detected user interaction by:

altering a position of the one or more moveable drip heads; and altering the illumination of the plurality of liquid droplets.

9. The storage medium of claim 8, wherein displaying the multi-colored animation comprises computer-readable program code configured to:

activate a first light source when a first droplet of the plurality of liquid droplets is at a first location along the vertical path; and activate a second light source when the first droplet is at a second location along the vertical path, wherein the first and second light sources are activated during non-overlapping time periods, and wherein the first and second light source emit different color light.

10. The storage medium of claim 9, wherein the first and second light sources are both activated within a time frame such that, from a perspective of a viewer, the first and second light sources are activated simultaneously to generate an image of the multi-colored animation.

11. The storage medium of claim 9, wherein the first light source is activated for a different duration than the second light source to generate the multi-colored animation.

12. The storage medium of claim 8, wherein the multi-colored animation comprises a first image and a second image, wherein both the first and second images comprise a first colored portion and a second colored portion, wherein at least one of the first and second colored portions is in a different location along the vertical path in the first image than in the second image.

13. The storage medium of claim 8, wherein altering the multi-colored animation comprises at least one of changing a type of the multi-colored animation and changing a rate at which images forming the multi-colored animation are changed.

14. The method of claim 1, wherein detecting the predefined user interaction with the animated dripping system comprises:

capturing, using the one or more sensors, a user motion interaction with the multi-colored animation; and determining that the captured user motion matches a predefined gesture; and wherein matching the predefined user interaction to a predefined action taken by the animated dripping system comprises:

matching the predefined gesture with a corresponding predefined action to alter the multi-colored animation.

15. The method of claim 1, wherein altering the multi-colored animation comprises:

transmitting a signal to a controller of the animated dripping system indicating a predefined gesture was performed.

* * * * *